United States Patent [19]

Alt et al.

[11] Patent Number: 4,900,375

[45] Date of Patent: Feb. 13, 1990

[54] MAGNESIUM-TREATED, DECARBURIZINGLY-ANNEALED CAST IRON MATERIAL

[75] Inventors: Anton Alt, Schaffhausen, Switzerland; Guenter Schulte, Volkertshausen, Fed. Rep. of Germany; Peter Toelke, Diessenhofen, Switzerland; Ludwig Wilhelm, Engen, Fed. Rep. of Germany

[73] Assignee: Georg Fischer AG, Schaffhausen, Switzerland

[21] Appl. No.: 94,705

[22] Filed: Sep. 9, 1987

[51] Int. Cl.[4] ..... C22C 37/04; C21D 5/00

[52] U.S. Cl. ..... 148/139; 148/138; 148/321; 148/901

[58] Field of Search ..... 148/321, 901, 16, 138, 148/139; 420/23, 27

[56] References Cited

U.S. PATENT DOCUMENTS

| | | | |
|---|---|---|---|
| 2,763,583 | 9/1956 | Kawasaki | 148/322 |
| 3,155,498 | 11/1964 | Jandras | 148/322 |
| 4,040,875 | 8/1977 | Noble | 148/321 |
| 4,096,002 | 6/1978 | Ikawa | 148/322 |
| 4,173,500 | 11/1979 | Kawaguchi | 148/321 |

FOREIGN PATENT DOCUMENTS

| | | | |
|---|---|---|---|
| 496098 | 9/1970 | Switzerland . | |
| 1175644 | 12/1969 | United Kingdom | 148/16 |

OTHER PUBLICATIONS

"Richtreihen Zur Kennzeichnung Der Graphitausbildung", VDG Merkblatt, p. 441, Aug. 1962.

*Primary Examiner*—Deborah Yee

*Attorney, Agent, or Firm*—Marmorek, Guttman & Rubenstein

[57] ABSTRACT

A magnesium-treated, decarburizingly-annealed cast iron material includes 4% or less carbon by weight, 2% or less silicon by weight, at least 0.010% magnesium by weight, and at least 0.001% sulphur by weight, the remainder being iron. The cast iron material is subjected to a first annealing phase in which graphitic carbon portions are formed. Thereafter, the cast iron material undergoes a second annealing phase during which certain of the graphitic carbon portions are burned out. The resultant structure includes cavities in place of certain of the graphitic carbon portions in a substantially ferritic matrix. The resultant cast iron material exhibits good welding and cutting properties with little susceptibility to hard cracking.

19 Claims, No Drawings

MAGNESIUM-TREATED, DECARBURIZINGLY-ANNEALED CAST IRON MATERIAL

BACKGROUND OF THE INVENTION

The present invention relates to a cast iron material which exhibits good welding and workability characteristics.

In order to produce a cast iron material which exhibits good welding and good workability properties for activities such as cutting, the cast iron material is subjected to decarburization and annealing. Traditionally, it has also been necessary to include so-called "chip-breakers" in the cast iron material. In malleable cast iron having these properties, manganese sulfides (MnS) and temper carbon are often used as the chip-breakers. After treating the cast iron material in the above manner, the iron casting thereby obtained may then be welded, cut, etc.

A number of different procedures have been used in the prior art to obtain a cast iron material having good workability properties. However, these methods have produced relatively unsatisfactory results.

According to one procedure, a raw or undressed iron casting which also contains 2.7–3.0% carbon (C), 0.25–0.35% silicon (Si), 0.70–0.85% manganese (Mn), 0.02–0.06% sulphur (S), and customary proportions of phosphorus (P) is oxidized and annealed at a temperature in the range of 1020° C.–1070° C. The nonmagnetic solid solution of ferritic carbide present is removed during its austenitic phase. The iron carbide therefore does not decompose to temper carbon. The ferritic carbide which is removed, forms a ferritic or ferritic-pearlitic structure because of the relatively low silicon and sulphur content of the raw material. Accordingly, a large excess of manganese is present.

This procedure has a serious drawback in that once a ferritic or ferritic-pearlitic structure is formed, the composition must then be adapted for its use as a weldable and malleable cast iron. For example, the sulphur content of the resultant composition (from 0.02–0.06%) is considerably higher than the amount customarily included in a composition exhibiting good welding characteristics. Therefore, in order to impart good welding characteristics to this composition, it is necessary to desulphurize the melt, a procedure which is extremely expensive.

In another procedure, a malleable cast iron having a standard composition, namely, 2.0–3.0% C, 0.6–1.5% Si, and less than 0.6% Mn, 0.15% P, and 0.15% S, respectively, is used as the starting material. The cast iron is subjected to decarburizing-annealing at a temperature between 950° C.–1100° C. The malleable cast iron material obtained in this procedure, as well as the procedures discussed above, solidifies in the mold in a graphite-free manner, the carbon being bound in the form of $Fe_3C$ (carbide).

Other procedures have employed black heart malleable iron to obtain a material with the desired properties. In one such procedure, black heart malleable iron is treated with pure magnesium. The casting is then annealed in a stepwise manner at about 700° C.–900° C. However, the resultant material cannot be used for construction weldings with high stress or high load requirements because high concentrations of graphite carbon are present in the generally ferritic base mass. These high concentrations of graphite carbon cause strain upon hardening of the composition and blister formation.

More recently, it has been proposed to render nodular cast iron, or iron which contains spheroidal graphite inclusions, suitable for welding, cutting, etc. It is well known in the art that through appropriate magnesium treatment, the uncombined carbon in the cast iron melt take the compact spheroidal form which is characteristic of nodular cast iron. Nodular cast iron possess greatly improved mechanical properties of the castings in addition to other different properties than that found in grey cast iron.

A nodular cast iron which exhibits good welding characteristics is known from Swiss patent 496,098. The desired characteristics are obtained by subjecting the nodular cast iron pieces to a decarburizing-annealing phase which must be effected within a temperature range between 900° C.–1200° C. The nodular cast iron which is used contains about 2.4–3.4% C, 0.4–2.4% Si, 0.1–0.7% Mn, 0.07% P, 0.005% or less S, and a residual Mg content of 0.02–0.10% by weight, the remainder being iron. The decarburization is carried out until the desired carbon content in the casting has been obtained. As an additional step, the magnesium-treated melt is inoculated with small amounts of ferrosilicon at a terminal stage in order to counteract the susceptibility to hard cracking. The resultant material has a decreased carbon content at least in the welding zones. The majority of the carbon present within the cast iron after treatment is in the form of spheroidal graphite, in contrast to the $Fe_3C$ found in the procedures outlined above.

However, the process disclosed in the Swiss patent is also unfavorable because of the high Si content of the cast iron material. The high Si content causes the undesirable and uncontrollable production of FeO.

It is therefore an object of the present invention to provide a process for the production of a cast iron material which possesses good material qualities while providing a nearly-faultless surface with good workability characteristics.

It is another object of the present invention to provide a process for the production of a nodular cast iron material which does not require the addition of MnS and temper carbon as chip-breakers.

It is a further object of the present invention to provide a process for the production of a material which employs nodular cast iron and which does not result in the undesirable production of FeO.

It is yet another object of the present invention to provide a process and material which is characterized by good weldability and at the same time by good cutting properties.

SUMMARY AND DETAILED DESCRIPTION OF THE PREFERRED EMBODIMENT

These and other objects are attained by the present invention which provides a nodular cast iron material which has excellent workability characteristics and a process for producing the same.

In accordance with these objects, a nodular cast iron material is formed in a first phase by annealing a casting which includes 4% or less C by weight; 2% or less Si by weight; at least 0.010% to about 0.03% Mg by weight; and at least 0.001% to about 0.004% of S by weight, the remainder being iron, at a temperature range from about 900° C. to about 1100° C. Thereby spheroidal graphitic carbon portions are created by precipitation as a consequence of inoculating additions which have been introduced into the liquid melt. Thereafter, the cast iron material undergoes a second annealing phase in which certain spheroidal graphitic carbon portions which were formed in the first phase are burned out. The decarburization of the cast iron material in the second phase produces cavities in an extensively ferritic matrix which replace the function and need for chip breakers such as MnS and temper carbon.

The cavities which are left in those areas where the spheroidal graphitic portions were burned out are likewise essentially spheroidal or globular in shape. These cavities are essentially found at or near the surface of the cast iron material. The cavities which are located on the surface of the material appear as depressions.

The permissible carbon content in the cast iron material following the second annealing phase is dependent on the thickness of the castings to be worked with. Generally, the spheroidal graphitic carbon content in the final product should be smaller than about 0.30 percent by weight in a surface zone having a depth of cast iron material of about 0.315 inches, and about 0 to 0.28 percent by weight in a depth of the cast iron material of about 0.12 to 0.235 inches.

It has been found that through appropriate magnesium treatment of a cast iron material, combined in some instances with inoculating and/or alloy additions, good conditions are created for the controlled decarburization of the cast iron in the second phase.

Preferentially, the inoculating procedure to be used is that which is disclosed in U.S. application Ser. No. 944,766, filed on Dec. 22, 1986 for the production of nodular cast iron. Additionally, a treatment vessel which may be preferentially used to obtain the nodular cast iron is disclosed in U.S. application Ser. No. 946,752, filed Dec. 29, 1986. Both of these applications are assigned to the assignee of the present application, and are incorporated herein by reference.

In a preferred embodiment, the cavities which are produced in the foregoing process have a configuration that is essentially identical with the graphite shapes according to the Verein Deutscher Giessereifachleute (VDG Code of Practice), P441, standard series II-VI. The cavities are preferably located in a welding zone located at or near the surface of the cast iron material, and represent from about 6% to about 13% by volume of the material in the welding zone.

In another preferred embodiment, at least one alloy element may be added to the cast iron material. For example, molybdenum (Mo) can be added as an alloy component to increase thermal resistance. Preferentially, the alloy element consists of one or more elements from the series of transition elements of the periodic table.

In yet another preferred embodiment, the first phase is carried out over a period of 3.5 hours.

In a further preferred embodiment, the temperature in either one or both phases of the annealing process is 1070° C.

The present invention is particularly advantageous as compared to the prior art in that the resultant composition is suitable for all welding processes. In addition, the burning out or combustion of the carbon in the second phase facilitates the presence of discontinuations in rods of cast iron material which can be formed after the second phase. Thus, the globular cavities provide the composition with the desired chippability which was only attainable in the prior art through the use of chipbreakers such as MnS or temper carbon.

The following examples will serve to further illustrate the present invention, but are not meant to limit it thereto.

EXAMPLE 1

In a first annealing phase, a cast iron material including 3.2% by weight of C, 0.8% by weight of Si, 0.03% by weight of Mg, 0.40% by weight of Mn and 0.001 to 0.004% by weight of S is brought to a temperature of 1070° C. for a period of approximately 3.5 hours. Spheroidal graphitic carbon portions are thereby created.

The cast iron material is then subjected to a second phase of annealing during which certain of the spheroidal graphitic carbon portions are burned out, leaving behind globular cavities on or near the surface of the cast iron material in a substantially ferritic matrix. The second phase is carried out until the desired carbon content has been obtained, or in this instance until the sum total of the cavities represent approximately 11% of the cast iron material by volume.

The structure of the composition obtained by the above process has excellent workability properties. For instance, the structure exhibits good welding and cutting properties, with little susceptibility to hard cracking. Moreover, the cast iron material which is obtained is suitable for all welding processes.

EXAMPLE 2

In a first annealing phase, a cast iron material including 3.2% by weight of C, 0.8% by weight of Si, 0.03% by weight of Mg, 0.40% by weight of Mn, 0.001 to 0.004% by weight of S, and a suitable amount of Mo is brought to a temperature of 1070° C. for a period of approximately 3.5 hours. Spheroidal graphitic carbon portions are thereby created in the cast iron material.

The cast iron material is then subjected to a second phase of annealing in which certain of the spheroidal graphitic carbon portions are burned out, leaving behind a substantially ferritic matrix with globular cavities similar to that which was obtained in Example 1. The sum total of the cavities represents approximately 11% of the cast iron material by volume.

Once again, the structure of the composition obtained by the above process has excellent workability properties. For instance, the structure exhibits good welding and cutting properties, with little susceptibility to hard cracking. Moreover, the cast iron material which is obtained is suitable for all welding processes. Additionally, due to the addition of Mo, the thermal resistance of the final product is increased.

While the invention has been described by reference to specific embodiments, this was for purposes of illustration only and should not be construed to limit the spirit or the scope of the invention.

What is claimed is:

1. A magnesium-treated, decarburized and annealed nodular cast iron material, comprising less than or equal to 4% carbon by weight;

less than or equal to 2% silicon by weight;

at least 0.010% to about 0.03% magnesium by weight;

at least 0.001% to about 0.004% sulphur by weight, the remainder being iron, said cast iron material including a surface zone having less than 0.3% graphitic carbon by weight and cavities in a substantially ferritic matrix.

2. A magnesium-treated, decarburized and annealed nodular cast iron material according to claim 1, further comprising inoculating agents.

3. The cast iron material of claim 1, wherein said cast iron material comprises 3.2% carbon by weight, 0.8% silicon by weight, 0.010% magnesium by weight, and 0.001% sulphur by weight, the remainder being iron.

4. The cast iron material of claim 1, further comprising molybdenum in an amount effective to increase thermal resistance.

5. The cast iron material of claim 1, further comprising an element selected from the group consisting of the series of transition elements and mixtures thereof in an amount effective to increase thermal resistance.

6. The cast iron material of claim 1, wherein said cavities are globular in shape.

7. The cast iron material of claim 1, wherein the amount of cavities in the surface zone comprises about 6 to 13 percent by volume of the surface zone.

8. A two-phase process for producing a magnesium-treated, decarburized and annealed cast iron material with good workability properties, comprising annealing a cast iron material comprising less than or equal to 4% carbon by weight; less than or equal to 2% silicon by weight; at least 0.010% to about 0.03% magnesium by weight; and at least 0.001% to about 0.004% sulphur, the remainder being iron, in a first phase to produce a surface zone having spheroidal graphitic carbon portions therein;

burning out said spheroidal graphitic carbon portions that had been formed in said first phase in a second annealing phase, thereby generating a surface zone having less than 0.3% by weight of spheroidal graphitic carbon x and cavities in a ferritic matrix.

9. The process of claim 8, wherein said cast iron material comprises 3.2% carbon, 0.8% silicon, 0.010% magnesium, and 0.001% sulphur by weight, the remainder being iron.

10. The process of claim 8, further comprising molybdenum in an amount effective to increase thermal resistance.

11. The process of claim 8, further comprising an element selected from the group consisting of the series of transition elements and mixtures thereof in an amount effective to increase thermal resistance.

12. The process of claim 8, wherein said first phase is carried out at a temperature of about 1070° C.

13. The process of claim 8, wherein said second phase is carried out at a temperature of about 1070° C.

14. The process of claim 8, wherein said cavities comprise 6–13% of volume of the surface zone.

15. A magnesium-treated, decarburized and annealed cast iron material, comprising less than or equal to 4% carbon by weight;

less than or equal to 2% silicon by weight;

at least 0.001% 0.010% to about 0.03% magnesium by weight;

at least 0.001% to about 0.004% sulphur by weight; the remainder being iron, said cast iron material including a surface zone having less than 0.3% spheroidal graphitic carbon by weight and cavities in a substantially ferritic matrix, said cavities comprising about 6 to 13 percent by volume of said surface zone, the remainder of said cast iron material being substantially cavity free.

16. The process of claim 8 wherein said first phase is carried out at a temperature of about 900°–1100° C.

17. The process of claim 8 wherein said second phase is carried out a temperature of about 900°–1100° C.

18. The cast iron material of claim 1 wherein said graphitic carbon comprises spheroidal graphitic carbon.

19. The cast iron material of claim 1 wherein the remainder of said cast iron material is substantially cavity free.

* * * * *